United States Patent [19]

Lew

[11] Patent Number: 4,826,227

[45] Date of Patent: May 2, 1989

[54] DISPOSABLE COUPLED CHOPSTICKS

[76] Inventor: Hyok S. Lew, 7890 Oak St., Arvada, Colo. 80005

[21] Appl. No.: 693,586

[22] Filed: Jan. 22, 1985

[51] Int. Cl.[4] ..... A47G 21/10

[52] U.S. Cl. ..... 294/16; 294/99.2

[58] Field of Search ..... 294/16, 3, 8.5, 11, 294/28, 29, 31 R, 33, 99.1, 99.2, 100, 118

[56] References Cited

U.S. PATENT DOCUMENTS 4,199,180 4/1980 Kelly ..... 294/16

4,312,530 1/1982 Young ..... 294/16

*Primary Examiner*—James B. Marbert

[57] ABSTRACT

This invention relates to extremely inexpensive coupled chopsticks comprising a pair of sticks mechanically coupled to one another by a curled wire spring that is secured to the chopsticks in a novel way. The coupling of two sticks by a novel wire spring of the present invention is compatible with the conventional disposable chopsticks comprising two sticks partially attached to one another at one extremity thereof which are to be split into two separate sticks at the time of use as well as with the traditional chopsticks comprising two separate sticks.

17 Claims, 1 Drawing Sheet

DISPOSABLE COUPLED CHOPSTICKS

BACKGROUND OF THE INVENTION

There are many ways to mechanically couple a pair of sticks constituting a pair of chopsticks by using a spring of construction that can have a greate deal of variety in design and structure. In general, a successful idea employed to couple a pair of sticks in constructing a pair of coupled chopsticks must satisfy the following two conditions: Firstly, a pair of coupled chopsticks has to function well. The mechanical spring coupling two sticks must maintain and restore the spring biased state of two sticks disposed on a common plane in an oblique angle with respect to one another. At the same time, the mechanical spring must provide a restraint that checks the skewing movement of two sticks when they are squeezed to one another in use. Secondly, the mechanical spring coupling the pair of sticks must have simple and aesthetic geometry and be inexpensive. One of the more novel and sophisticated inventions teaching the construction of a pair of coupled chopsticks was patented by the inventor of the present invention, which invention is covered by U.S. Pat. No. 3,888,456 and U.S. Pat. No. 3,937,510. Even though the aforementioned patented invention teaches how to construct a coupled chopsticks with an excellent aesthetic design and outstanding utility, the manufacturing cost of the coupled chopsticks constructed in accordance with the principles of the aforementioned patented invention cannot be lowered to the point where the cost is low enough to throw away the coupled chopsticks after a single use.

The primary object of the present invention is to provide a pair of coupled chopsticks that is cheap enough to be thrown away after a single use.

Another object is to provide a pair of coupled chopsticks comprising a pair of sticks which are partially attached to one another at one extremity like conventional disposable chopsticks which are split into two sticks at the time of use by the user.

A further object is to provide a pair of coupled chopsticks that has an aesthetic design.

Yet another object is to provide a pair of coupled chopsticks that has a good utility.

Yet a further object is to provide a pair of coupled chopsticks comprising a pair of wooden sticks coupled to one another by a metalic wire spring.

These and other objects of the present invention will become clear as the description thereof proceeds.

BRIEF DESCRIPTION OF FIGURES

The present invention may be described with a greater clarity and specificity by referring to the following figures.

DESCRIPTION OF THE ILLUSTRATED EMBODIMENTS

Figure 1:
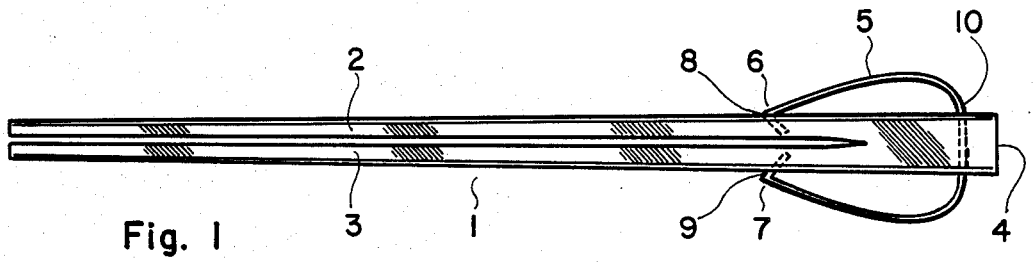
FIG. 1 illustrates a plan view of a pair of disposable coupled chopsticks constructed in accordance with the principles of the present invention.
Figure 6:
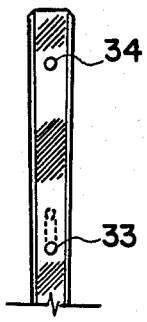
FIG. 6 illustrates a view of an extremity of an enbodiment of a stick included in a pair of disposable coupled chopsticks such as those shown in FIGS. 1, 2, 3 and 4, which view is taken in a direction parallel to a plane including two sticks included in a coupled chopsticks.
Figure 7:
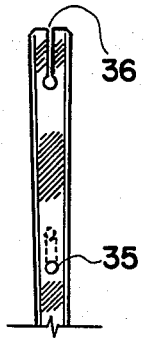
FIG. 7 illustrates a view of an extremity of another embodiment of a stick included in a pair of disposable coupled chopsticks such as those shown in FIGS. 1, 2, 3 and 4.

In FIG. 1 there is illustrated a plan view of an embodiment of a pair of disposable coupled chopsticks constructed in accordance with the principles of the present invention. The disposable coupled chopsticks 1 comprises a pair of sticks 2 and 3 partially attached to one another at one extremity 4, which combination is arranged in the same manner as the typical conventional disposable chopsticks commonly handed out in the side-walk noodle shops in the orient, and an open-loop spring or horse-shoe shaped spring 5, which is a spring wire curved into an open loop of circular or elliptical geometry. Each of two extremities 6 and 7 of the open-loop spring 5 is bent into an acute angle on a plane including the open-loop spring 5 wherein each bent tip points toward the inner zone of the spring loop. The stick 1 includes a hole 8 disposed therein intermediate two extremities thereof on the pivoting plane of chopsticks, that is disposed at an angle in the general direction intermediate the other stick 3 and the attached extremity 5 of the chopsticks wherein the hole 8 is engaged by one bent tip 6 of the open-loop spring 5. The stick 2 includes a hole 9 disposed therein substantially in a mirror image to the hole 8 included in stick 1, wherein the hole 9 is engaged by the other bent tip 7 of the open-loop spring 5. The portion 10 of the open-loop spring 5 diametrically opposite to the open end thereof is secured to the attached extremity 4 of the pair of chopsticks as that portion is retained in a hole or slot disposed therein as it is illustrated in FIGS. 6 or 7. When the disposable coupled chopsticks 1 is in use, it is split into two separate sticks by tearing apart the attached portion thereof as shown in FIG. 2.

Figure 2:
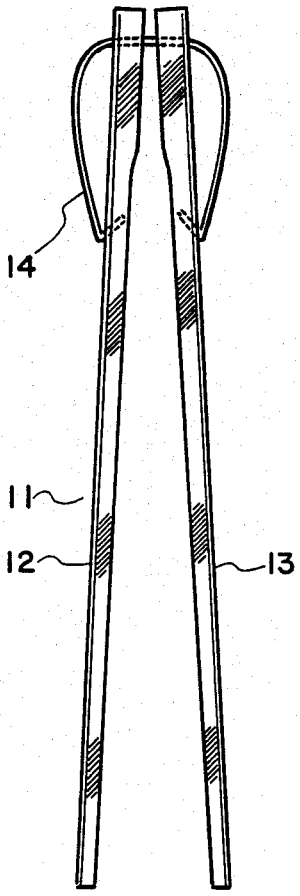
FIG. 2 illustrates a plan view of the disposable coupled chopsticks shown in FIG. 1 that is now split for use.

In FIG. 2 there is illustrated a plan view of a pair of coupled chopsticks 11 comprising two separate sticks 12 and 13 which are coupled to one another by an open-loop spring 14 having the same construction as the open-loop spring 5 shown in FIG. 1. The coupled chopsticks 11 may be constructed of two separate sticks 12 and 13 or may result from the disposable coupled chopsticks 1 shown in FIG. 1 when two partially attached sticks 2 and 3 are split apart.

Figure 3:
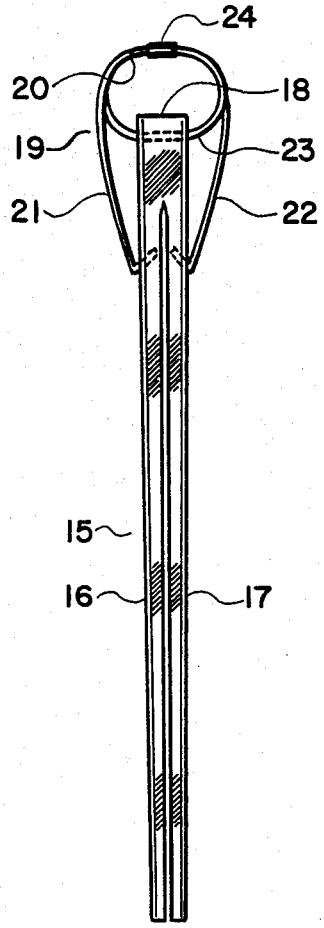
FIG. 3 illustrates a plan view of another pair of disposable coupled chopsticks constructed in accordance with the principles of the present invention.

In FIG. 3 there is illustrated a plan view of another pair of disposable coupled chopsticks including a pair of sticks 16 and 17 partially attached to one another at one extremity 18 thereof and a safety pin-like spring 19 including a coil 20 and a pair of legs 21 and 22 extending therefrom in a diverging angle. The tips of the two diverging legs are prepared in the same configuration as the tips of the open-loop spring 5 shown in FIG. 1 and secured to the sticks 16 and 17 in the same manner as shown in FIG. 1. The portion 23 of the coil 20 isolated from the two legs 31 and 22 is secured in a hole or slot disposed in the attached extremity 18 of the chopsticks as to be explained in conjunction with FIGS. 6 or 7. A fastening means 24 may be included to tie down the coil 20 and the roots of legs 21 and 22 of the safety pin-like spring 19.

Figure 4:
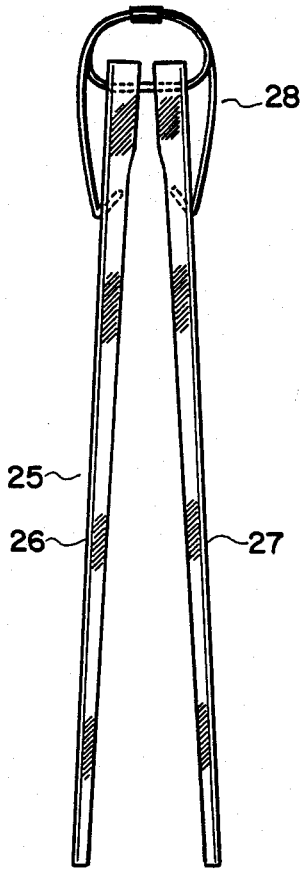
FIG. 4 illustrates the disposable coupled chopsticks shown in FIG. 3 that is now split for use.

In FIG. 4 there is illustrated a pair of coupled chopsticks comprising two separate sticks 26 and 27, which sticks are coupled to one another by a safety pin-like spring 28 having the same construction as the element 19 shown in FIG. 3. The coupled chopsticks 25 may be constructed of two separate sticks 26 and 27 or may result from the disposable coupled chopsticks 15 shown in FIG. 3 when two partially attached sticks 16 and 17 are split apart.

Figure 5:
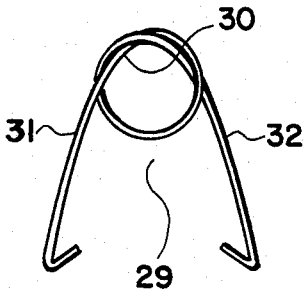
FIG. 5 illustrates a metallic wire spring that is usable in constructing a pair of disposable coupled chopsticks shown in FIG. 3 or FIG. 4.

In FIG. 5 there is illustrated a plan view of another safety-pin like spring 29 that can be employed in place of the safety pin-like spring 28 in constructing the coupled chopsticks shown in FIGS. 3 and 4. The coil 30 of the safety pin-like spring 29 comprises a wire knotted into a loose overhand knot that extends to a pair of legs 31 and 32. In this illustration, the preparation of the tip of the legs is clearly illustrated, which preparation applies to all springs employed in constructing the coupled chopsticks shown in FIGS. 1, 2, 3 and 4.

In FIG. 6 there is illustrated an elevation view of one extremity of two partially attached sticks as in the case of FIGS. 1 and 3 or of two separate sticks as in the case of FIGS. 2 and 4, which view is observed in a direction parallel to the pivoting plane of the chopsticks. The inclined hole 33 disposed in each stick intermediate two extremities thereof receives the bent tip of the coupling spring, while the through hole 34 disposed at one extremity of the stick is engaged and extended through by the mid portion of the open-loop spring shown in FIGS. 1 and 2 or by the mid portion of the coil of the safety pin-like springs shown in FIGS. 3, 4 and 5.

In FIG. 7 there is illustrated an elevation view of one extremity of two partially attached sticks or of two separate sticks which includes a preparation modified from that shown in FIG. 6. The inclined hole 35 receives the bent tip of the coupling spring while the slot 36 open to one extremity of the stick accepts and secures the mid portion of the open-loop spring or the mid portion of the coil of the safety pin-like spring. The employment of the slot 36 open to one end of the stick in place of the hole 34 as shown in FIG. 6 provides an important advantage in that the preformed coupling spring with angled tips can be fastened directly to the two partially attached sticks or to the two separated sticks, as it is not required to thread the wire constituting the coupling spring through a hole such as the member 34 shown in FIG. 6.

Figure 8:
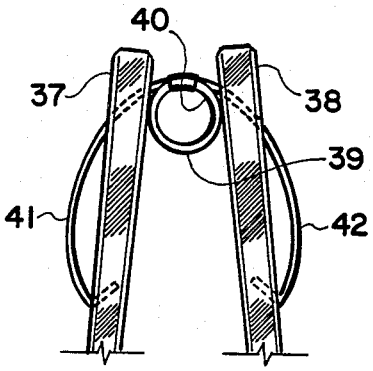
FIG. 8 illustrates a different embodiment of coupling a pair of sticks by using the same spring as that employed in the disposable coupled chopsticks shown in FIGS. 3 and 4.

In FIG. 8 there is illustrated two separate sticks 37 and 38 coupled to one another by a safety pin-like spring 39 that is constructed essentially in the same manner as the safety pin-like spring employed in FIGS. 3 and 4 with one exception being that the size of the coil 40 is made significantly smaller in comparison with the length of the legs 41 and 42. The coil 40 of the safety pin-like spring 39 is disposed intermediate two sticks 37 and 38 as the root portion of each leg is retained within the slot open to one extremity of each stick as shown in FIG. 7, while the bent tip of each leg is anchored in the inclined hole included in each stick. Of Course, the sticks 37 and 38 may be prepared as shown in FIG. 6 instead of FIG. 7, in which case, the tip of the leg of the safety pin-like spring must be bent into a proper angle only after the leg is threaded through the hole disposed at one extremity of the stick. The safety pin-like spring 29 shown in FIG. 5 may be employed in place of the element 39 in constructing a coupled chopstick similar to the embodiment shown in FIG. 8. Of course, the embodiment shown in FIG. 8 is not compatible with two partially attached sticks, which combination is commonly employed in the arrangement of a pair of disposable chopsticks.

While the principles of the present invention have now been made clear by the illustrative embodiments, there will be immdiately obvious to those skilled in the art many modifications of the structures, arrangements, proportion, elements and materials which are particularly adapted to the specific working environments and operating conditions in the practice of the invention without departing from those principles.

I claim:

1. A coupled chopsticks comprising in combination: a first stick including an inclined hole open to one side of said first stick disposed intermediate two extremities of said first stick wherein said inclined hole in inclined toward one extremity of said first stick including means for securing a wire segment; a second stick including an inclined hole open to one side of said second stick disposed intermediate two extremities of said second stick wherein said inclined hole is inclined toward one extremity of said second stick including means for securing a wire segment, said first and second sticks disposed in a side-by-side relationship wherein said inclined hole included in said first stick and said inclined hole included in said second stick are disposed on a common plane substantially in a mirror image to one another; and an open-loop spring with first acute-angled extremity anchored in said inclined hole included in said first stick and with a second acute-angled extremity anchored in said inclined hole included in said second stick, wherein mid portion of said open-loop spring intermediate said first and second acute angled extremities is secured to said one extremities of said first and said second sticks by said means for securing a wire segments.

2. The combination as set forth in claim 1 wherein said first and second sticks are partially attached to one another at said one extremity.

3. The combination as set forth in claim 2 wherein said means for securing a wire segment included in said one extremities of said first and second sticks respectively comprise a slot open to said one extremity of each of said first and second sticks disposed on a plane substantially including said inclined holes included in said first and second sticks, wherein said slots receive and retain said mid portion of said open-loop spring.

4. The combination as set forth in claim 2 wherein said means for securing a wire segment included in said one extremities of said first and said second sticks respectively comprise a hole disposed through each of said first and second sticks at said one extremity in a direction substantially parallel to a plane including said inclined holes included in said first and second sticks, wherein said mid portion of said open-loop spring engages and extends through said holes disposed through said first and second sticks at said one extremities.

5. The combination as set forth in claim 2 wherein said first and second sticks are separated from one another.

6. The combination as set forth in claim 5 wherein said means for securing a wire segment included in said one extremities of said first and second sticks respectively comprise a slot open to said one extremity of each of said first and second sticks disposed on a plane substantially including said inclined holes included in said first and second sticks, wherein said slots receive and retain said mid portion of said open-loop spring.

7. The combination as set forth in claim 5 wherein said means for securing a wire segment included in said one extremities of said first and said second sticks respectively comprise a hole disposed through each of said first and second sticks at said one extremity in a direction substantially parallel to a plane including said inclined holes included in said first and second sticks, wherein said mid portion of said open-loop spring engages and extends through said holes disposed through said first and second sticks at said one extremities.

8. A coupled chopsticks comprising in combination: a first stick including an inclined hole open to one side of said first stick disposed intermediate two extremities of said first stick wherein said inclined hole is inclined toward one extremity of said first stick including means for securing a wire segment; a second stick including an inclined hole open to one side of said second stick disposed intermediate two extremities of said second stick wherein said inclined hole is inclined toward one extremity of said second stick including means for securing a wire segment, said first and second sticks disposed in a side-by-side relationship wherein said inclined hole inlcuded in said first stick and said inclined hole included in said second stick are disposed on a common plane substantially in a mirror image to one another; and a safety pin-like spring including a coil and a first leg and a second leg extending from said coil in a diverging configuration, said first leg including an acute-angled extremity anchored in said inclined hole included in said first stick, and said second leg including an acute-angled extremity anchored in said inclined hole included in said second stick, wherein a portion of said coil of said safety pin-like spring is secured to said one extremities of said first and said second sticks by said means for securing a wire segment.

9. The combination as set forth in claim 8 wherein said first and second sticks are partially attached to one another at said one extremity.

10. The combination as set forth in claim 9 wherein said means for securing a wire segment included in said one extremities of said first and second sticks respectively comprise a slot open to said one extremity of each of said first and second sticks disposed on a plane substantially including said inclined holes included in said first and second sticks, wherein said slots receive and retain a portion of said coil of said safety pin-like spring.

11. The combination as set forth in claim 9 wherein said means for securing a wire segment included in said one extremities of said first and said second sticks respectively comprise a hole disposed through each of said first and second sticks at said one extremity in a direction substantially parallel to a plane including said inclined holes included in said first and second sticks, wherein a portion of said coil of said safety pin-like spring engages and extends through said holes disposed through said first and second sticks at said one extremities.

12. The combination as set forth in claim 8 wherein said first and second sticks are separated from one another.

13. The combination as set forth in claim 12 wherein said means for securing a wire segment included in said one extremities of said first and second sticks respectively comprise a slot open to said one extremity of each of said first and second sticks disposed on a plane substantially including said inclined holes included in said first and second sticks, wherein said slots receive and retain a portion of said coil of said safety pin-like spring.

14. The combination as set forth in claim 12 wherein said means for securing a wire segment included in said one extremities of said first and said second sticks respectively comprise a hole disposed through each of said first and second sticks at said one extremity in a direction substantially parallel to a plane including said inclined holes included in said first and second sticks, wherein a portion of said coil of said safety pin-like spring engages and extends through said holes disposed through said first and second sticks at said one extremities.

15. A coupled chopsticks comprising in combination: a first stick including an inclined hole open to one side of said first disposed intermediate two extremities of said first stick wherein said inclined hole is inclined toward one extremity of said first stick including means for securing a wire segment; a second stick including an inclined hole open to one side of said second stick disposed intermediate two extremities of said second stick wherein said inclined hole is inclined toward one extremity of said second stick including means for securing a wire segment, said first and second sticks disposed in a side-by-side relationship wherein said inclined hole included in said first stick and said inclined hole included in said second stick are disposed on a common plane substantially in a mirror image to one another; and a safety pin-like spring including a coil and a first leg and a second leg extending from said coil in a diverging configuration, said first leg including an acute-angled extremity anchored in said inclined hole included in said first stick, said second leg including an acute-angled extremity anchored in said inclined hole included in said second stick, wherein the root of said first leg is secured to said one extremity of said first stick by said means for securing a wire segment and the root of said second leg is secured to said one extremity of said second stick by said means for securing a wire segment.

16. The combination as set forth in claim 15 wherein said means for securing a wire segment included in said one extremities of said first and second sticks respecitvely comprise a slot open to said one extremity of each of said first and second sticks disposed on a plane substantially including said inclined holes included in said first and second sticks, wherein said slots receive and retain the roots of said first and second legs of said safety pin-like spring.

17. The combination as set forth in claim 15 wherein said means for securing a wire segment included in said one extremities of said first and second sticks respectively comprise a hole disposed through each of said first and second sticks at said one extremity in a direction substantially parallel to a plane including said inclined holes included in said first and second sticks wherein said roots of said first and second legs respectively engage and extend through said holes disposed through said first and second sticks at said one extremities.

* * * * *